United States Patent [19]

Nishikawa

[11] 4,297,423

[45] Oct. 27, 1981

[54] ELECTROPHOTOGRAPHIC PROCESS FOR MULTIPLE IMAGES

[75] Inventor: Masaji Nishikawa, Hachioji, Japan

[73] Assignee: Olympus Optical Company Limited, Tokyo, Japan

[21] Appl. No.: 963,358

[22] Filed: Nov. 24, 1978

[30] Foreign Application Priority Data

Nov. 30, 1977 [JP] Japan ..... 52-142691

[51] Int. Cl.[3] ..... G03G 13/16; G03G 13/22

[52] U.S. Cl. ..... 430/54; 430/100; 430/126

[58] Field of Search ..... 118/658; 430/48, 54, 430/100, 126

[56] References Cited

U.S. PATENT DOCUMENTS

| | | | |
|---|---|---|---|
| 2,914,403 | 11/1959 | Sugarman | 430/48 |
| 3,041,167 | 6/1962 | Blakney et al. | 430/125 |
| 3,445,225 | 5/1969 | Brynko et al. | 430/54 |
| 3,764,207 | 10/1973 | Obuchi | 430/126 |
| 3,871,878 | 3/1975 | Mino et al. | 430/54 |

*Primary Examiner*—Richard L. Schilling
*Assistant Examiner*—John L. Goodrow
*Attorney, Agent, or Firm*—Haseltine and Lake

[57] ABSTRACT

An electrophotographic process comprising uniformly charging a composite photosensitive body with a charging polarity exhibiting a response property to a visible light, said composite photosensitive body being composed of a photoconductive semiconductor for producing carrier when illuminated by the visible light and a light transmitting organic photosemiconductor superimposed one upon the other, illuminating the charged composite photosensitive body with a light image by the visible light and producing thereon a first electrostatic latent image and producing thereon a second electrostatic latent image based on said first electrostatic latent image, said second electrostatic latent image having a polarity which is opposite to said charging polarity.

3 Claims, 18 Drawing Figures

ELECTROPHOTOGRAPHIC PROCESS FOR MULTIPLE IMAGES

BACKGROUND OF THE INVENTION

1. Field of the Invention

This invention relates to an electrophotographic process which makes use of a composite photosensitive body composed of an electrically conductive substrate, an inorganic photosemiconductor formed of Se or Se alloy or the like and an organic photosemiconductor mainly consisting of polyvinyl carbazole (hereinafter will be called as PVK) superimposed one upon the other.

2. Description of the Prior Art

Composite photosensitive bodies inclusive of a composite photosensitive body composed of an inorganic photosemiconductor formed of Se or Se alloy or the like and generating a carrier when illuminated by a visible light and an organic photosemiconductor formed of PVK or the like and having a charge holding and transferring ability, said inorganic and organic photosemiconductors being superimposed one upon the other, have been well known in the art. A composite photosensitive body comprising a specially defined barrier layer interposed between an electrically conductive substrate and an inorganic photosemiconductor so as to improve the charge holding ability has also been proposed. But, all of these conventional composite photosensitive bodies are inferior in dark attenuation property and hence have the drawback that the dark attenuation of the electrostatic charge image is too rapid to obtain a plurality of copies by repeatedly using an electrostatic latent image produced on the composite photosensitive body by one exposure of a manuscript. Such object can only be attained with difficulty by means of the composite photosensitive body in which the inorganic photosemiconductor is formed of pure selenium or the like, but could not be attained by means of the composite photosensitive body in which the inorganic photosemiconductor is formed of a mixture of Se and Te or the like and which has an improved sensitivity.

SUMMARY OF THE INVENTION

An object of the invention, therefore, is to provide an electrophotographic process which makes use of a composite photosensitive body, more particularly a photosensitive body having a high sensitivity, which can hold an electrostatic latent image for a long time and which can obtain a number of copies from one electrostatic latent image.

A feature of the invention is the provision of an electrophotographic process comprising uniformly charging a composite photosensitive body with a charging polarity exhibiting a response property to a visible light, said composite photosensitive body being composed of a photoconductive semiconductor for producing carrier when illuminated by the visible light and a light transmitting organic photosemiconductor superimposed one upon the other, illuminating the charged composite photosensitive body with a light image by the visible light and producing thereon a first electrostatic latent image, and producing thereon a second electrostatic latent image based on said first electrostatic latent image, said second electrostatic latent image having a polarity which is opposite to said charging polarity.

Further objects and advantages of the invention will be fully understood from the following detailed description with reference to the accompanying drawings, in which:

BRIEF DESCRIPION OF THE DRAWINGS

Figure 5A:
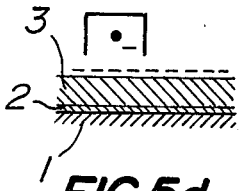
Figure 5B:
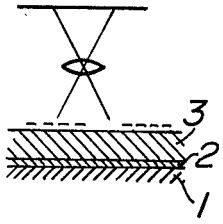
Figure 5C:
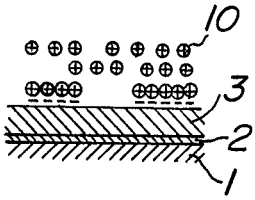
Figure 5D:
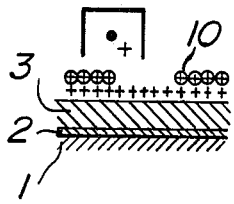
Figure 5E:
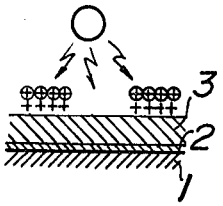
Figure 5F:
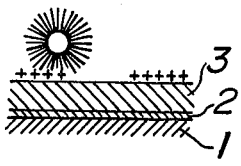
Figure 6:
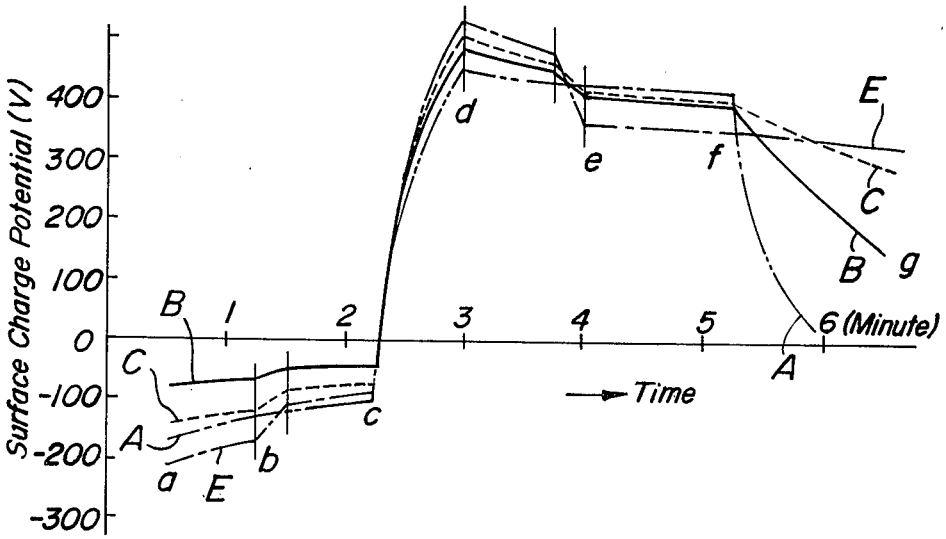
Figure 7:
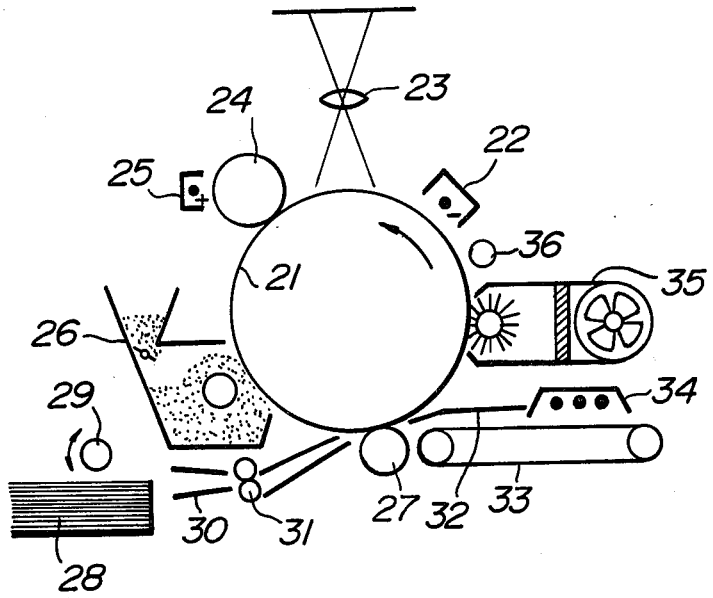
Figure 8:
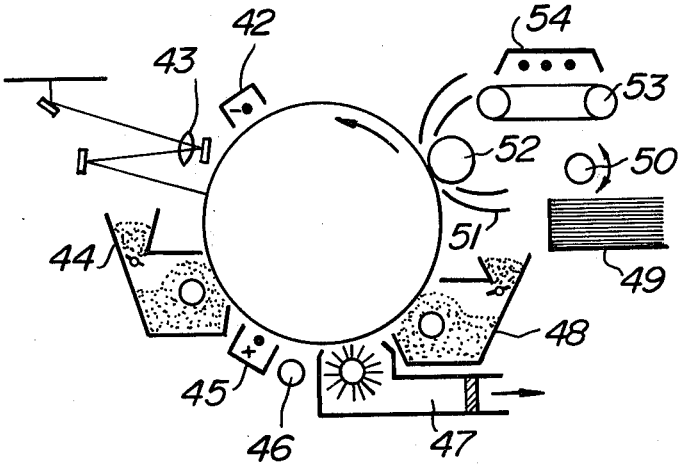

FIGS. 4*a* to 4*f* are diagrams showing one embodiment of an electrophotographic process according to the invention comprising a step of converting a polarity of an electrostatic latent image by uniformly applying thereto a positive charge;

FIGS. 5*a* to 5*f* are diagrams showing another embodiment of an electrophotographic process according to the invention comprising a step of converting a polarity of an electrostatic latent image by steps inclusive of a step of illuminating it by ultraviolet rays;

FIG. 6 is a graph showing change in surface charge potential of picture and nonpicture image portions of a photosensitive body produced by the process illustrated with reference to FIGS. 5*a* to 5*f*;

FIG. 7 is a diagram showing one embodiment of an electrophotographic apparatus for carrying out an electrophotographic process according to the invention comprising a step of converting a polarity of an electrostatic latent image by the process illustrated with reference to FIGS. 4*a* to 4*f*; and FIG. 8 is a diagram showing another embodiment of an electrophotographic apparatus for carrying out an electrophotographic process according to the invention comprising a step of converting a polarity of an electrostatic latent image by the process illustrated with reference to FIGS. 5*a* to 5*f*.

DETAILED DESCRIPTION OF THE PREFERRED EMBODIMENTS

A composite photosensitive body composed of an inorganic photosemiconductor formed of Se or Se alloy or the like and a light transmitting organic photosemiconductor formed of PVK or the like superimposed one upon the other functions to exhibit its photosensitive property and its charge holding and transfer ability separately by suitable materials, respectively, and hence is excellent in overall property. But, as described above, the property of the composite photosensitive body is not suitable for the use in which the electrostatic latent image produced by one exposure is repeatedly used to obtain a number of copies. Such tendency becomes more conspicuous for the composite photosensitive body in which the inorganic photosemiconductor is formed of a mixture of Se and Te and which has an improved sensitivity.

It has been well known that the composite photosensitive body composed of Se-PVK, Se·Te-PVK or the like exhibits an excellent light response property when it is charged with a negative polarity, but has a large dark attenuation value on the one hand and exhibits no light response property when it is charged with a positive polarity, but has a small dark attentuation value on the other hand. This is due to the fact that PVK functions to move a positive carrier, but not to move a negative carrier, these carriers being produced on the Se layer or on the Se·Te layer when it is illuminated by a visible light.

In the electrophotographic process according to the invention, in the first place, the composite photosensitive body is charged with the negative polarity and the high response property thereof under such condition is utilized to produce thereon an electrostatic latent image. Then, the polarity of the electrostatic latent image is converted by a suitable means to provide an electrostatic latent image charged with a photosensitive polarity. As described above, the positive polarity charge is substantially not attenuated and hence it is possible to hold the electrostatic latent image for a long time, thereby obtaining a plurality of copies.

The charging property, dark attenuation property and light response property of various kinds of composite photosensitive bodies when they are charged with positive and negative polarities will now be described.

Figure 1:
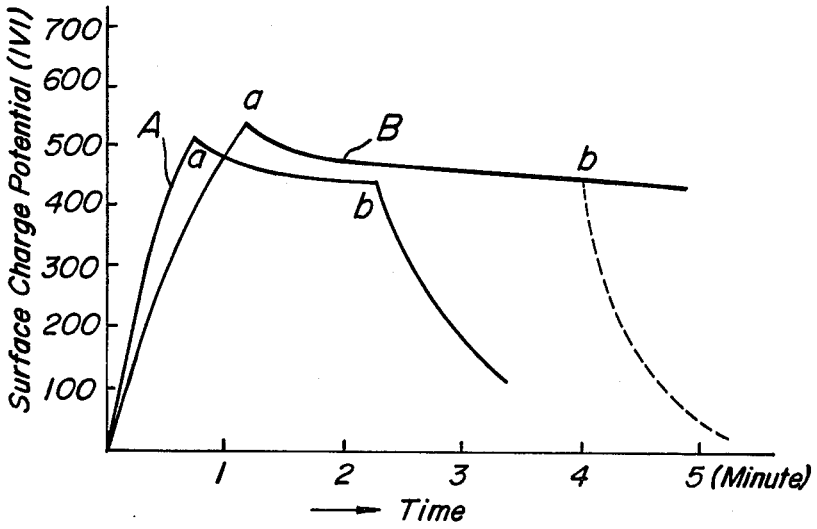
FIG. 1 is a graph showing a charge characteristic of a Se-PVK composite photosensitive body including a barrier layer.

FIG. 1 is a graph showing the charging property of a composite photosensitive body composed of an electrically conductive layer, a barrier layer disposed on the electrically conductive layer so as to decrease the dark attenuation of the negative charge, a noncrystalline Se layer having a thickness of 0.8$\mu$ and disposed on the barrier layer and a PVK layer coated on the noncrystalline Se layer and having thickness of about 20$\mu$. In FIG. 1, the ordinate shows the surface charge potential and the abcissa represents time. As shown in FIG. 1, the composite photosensitive body is charged in a dark room up to a time a and then the charging operation is stopped. The composite photosensitive body is left as it is in the dark room until a time b so as to investigate the dark attenuation. After the time b, the composite photosensitive body is exposed to light so as to investigate the light response property. The time scale is applied to the dark attenuation from the time a to the time b only. The above matters are also common to the following graphs.

In FIG. 1, a curve A shows the charging property of the composite photosensitive body when it is charged with the negative polarity, while a curve B shows the charging property of the composite photosensitive body when it is charged with the positive polarity. As can be seen from the curve B, the composite photosensitive body charged with the positive polarity exhibits no light response property at all.

The composite photosensitive body shown in FIG. 1 is provided with the barrier layer so as to decrease the dark attenuation thereof, and as a result, the composite photosensitive body charged with the negative polarity exhibits a fairly good dark attenuation property. Even though the composite photosensitive body is not provided with means for improving the dark attenuation thereof when it is charged with the positive polarity, the composite photosensitive body charged with the positive polarity exhibits considerably improved dark attenuation property. If provision is made of means for improving the dark attenuation of the composite photosensitive body when it is charged with the positive polarity, it is possible to expect a still further improved dark attenuation property of the composite photosensitive body.

As a result, the above mentioned electrophotographic process according to the invention is effective for the Se-PVK composite photosensitive body having a comparatively good dark attenuation property when it is charged with the negative polarity as in the case of the present example.

In FIG. 1, a dotted line curve C shows a light response property of the composite photosensitive body when it is charged with the positive polarity and exposed to ultraviolet rays. The light response property of each composite photosensitive body with respect to the ultraviolet rays is due to the photosensitive property of PVK.

Figure 2:
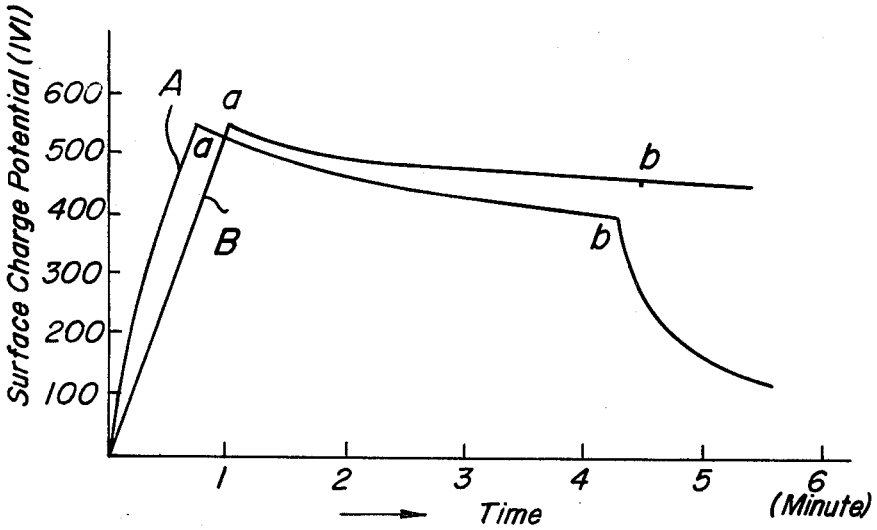
FIG. 2 is a graph showing a charge characteristic of a Se-PVK composite photosensitive body.

FIG. 2 is a graph showing the result of experimental tests which are effected on a Se-PVK composite photosensitive body not provided with a barrier layer which is provided in the case shown in FIG. 1.

In FIG. 2, a curve A shows a property of the composite photosensitive body when it is charged with the negative polarity, while a curve B shows a property of the composite photosensitive body when it is charged with the positive polarity. FIG. 2 shows that the composite photosensitive body charged with the positive polarity exhibits less dark attenuation and that the composite photosensitive body charged with the negative polarity only exhibits the light response property.

Figure 3:
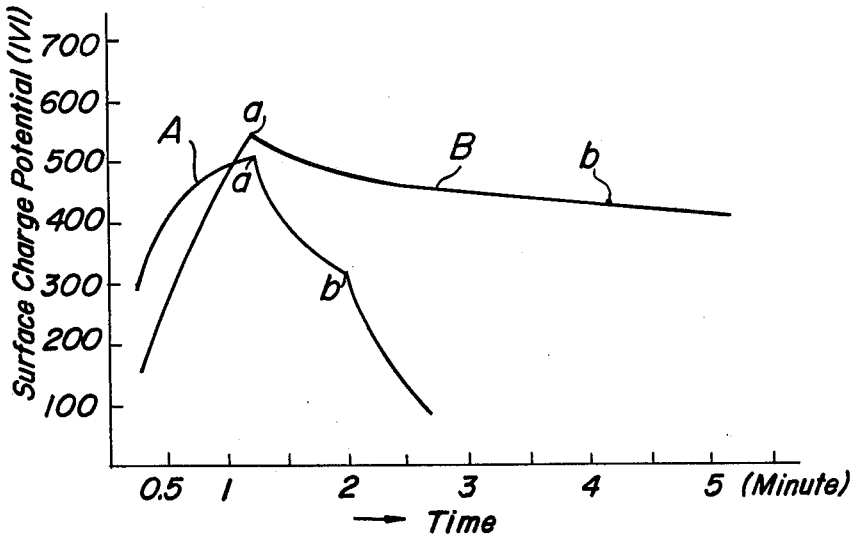
FIG. 3 is a graph showing a charge characteristic of Se·Te-PVK composite photosensitive body including a barrier layer.

FIG. 3 shows a property of a composite photosensitive body composed of an electrically conductive layer, a barrier layer formed of Parylene (Trade name, made by Union Carbide Co.) and having a thickness of about 0.3$\mu$ and disposed on the electrically conductive layer, a Se-Te alloy layer having a thickness of about 0.8$\mu$ and disposed on the barrier layer and a PVK layer having a thickness of 15$\mu$ and disposed on the Se-Te alloy layer.

In FIG. 3, a curve A shows a property of the composite photosensitive body charged with a negative polarity, while curve B shows a property of the composite photosensitive body charged with a positive polarity. As seen from the curve A, the composite photosensitive body charged with the negative polarity only exhibits light response property, but exhibits considerably large dark attenuation.

All the above three composite photosensitive bodies are more or less different in the degree of dark attenuation and light response property. But, the composite photosensitive body charged with the positive polarity is excellent in the charge holding ability, i.e. dark attenuation property, while the composite photosensitive body charged with the negative polarity is excellent in the light response property.

A process of converting the electrostatic latent image produced by the negative charge into the electrostatic latent image produced by the positive charge will now be described.

In a first process, a composite photosensitive body having an electrostatic latent image produced by a negative charge is uniformly charged with a positive polarity. It is preferable to substantially neutralize the charge of the negatively charged picture image portion or charge it to that degree by which the toner does not adhere thereto. As a result, the nonpicture image portion which has not been charged becomes positively charged, thereby producing a negative image due to the positive charge. If this negative image is developed by a positively charged toner, for example, it is possible to obtain a positive toned image. In this case of developing the negative image into the positive toned image, it is eventually required to apply a bias voltage. In such cases, it is preferable not to neutralize the charge of the picture image portion.

In any case, a problem arises as to how to give substantially equal charge to the picture and nonpicture image portions. This problem will now be described.

In the first place, the corona discharging process is inconvenient. This is because of the fact that if a thin line-shaped picture image portion is subjected to the corona discharge with a polarity which is opposite to that of the picture image portion, the electric field produced by the picture and nonpicture image portions causes the corona current to flow into the picture image portion to neutralize the charge thereof and make the electrostatic latent image thereon disappear.

In the first process according to the invention, in order to uniformly charge the picture and nonpicture image portions, a dielectric body surface is charged with a polarity which is opposite to that of an electrostatic latent image produced on a composite photosensitive body. This dielectric body surface is brought into contact with the composite photosensitive body to supply substantially uniform charge to the composite photosensitive body. As a result, it is possible to produce on the composite photosensitive body a negative electrostatic latent image charged with a polarity which is opposite to that of the electrostatic latent image which has been produced on the composite photosensitive body. This electrostatic latent image has a contrast which is determined by the electrostatic capacity of the composite photosensitive body, electrostatic capacity of the above mentioned dielectric body and the surface charge potential of the composite photosensitive body prior to its contact with the dielectric body. In order to obtain the suitable result, it is preferable to make the dielectric body relatively large in thickness, thereby making the surface charge potential high. In addition, it is preferable to sandwich a semiconductor layer between the dielectric body and an electrically conductive layer thereof and/or to superimpose the semiconductor layer on the electrically conductive layer of the composite photosensitive body for the purpose of uniformly transferring the charge from the dielectric body to the composite photosensitive body.

Figure 4A:
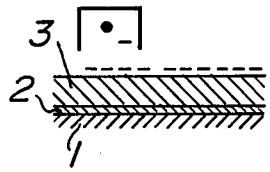
Figure 4B:
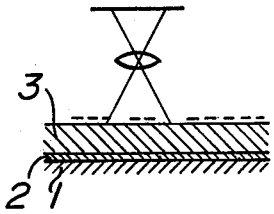
Figure 4C:
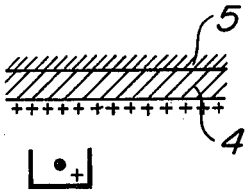
Figure 4D:
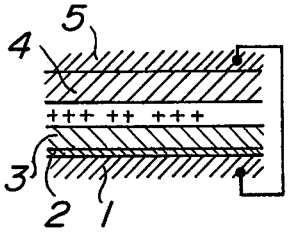
Figure 4E:
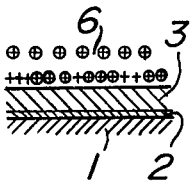
Figure 4F:
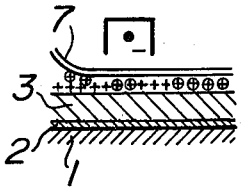

FIGS. 4*a* to 4*f* shows the above mentioned steps as a whole. FIG. 4*a* shows a step of uniformly charging a composite photosensitive body with a negative polarity, the composite photosensitive body being composed of an electrically conductive layer 1, Se or Se·Te layer 2 and PVK layer 3. FIG. 4*b* shows a step of illuminating the composite photosensitive body with a light image to produce a negative electrostatic latent image thereon. FIG. 4*c* shows a step of uniformly charging a dielectric body with a positive polarity, the dielectric body being composed of a dielectric layer 4 and electrically conductive layer 5. FIG. 4*d* shows a step of superimposing the charged photosensitive body shown in FIG. 4*b* and the charged dielectric body shown in FIG. 4*c* one upon the other and shortcircuiting the electrically conductive layers 1, 5 with each other to convert the polarity of the electrostatic latent image from negative to positive. FIG. 4*e* shows a step of developing the electrostatic latent image whose polarity has been converted into positive by a positively charged toner 6. FIG. 4*f* shows a step of transferring the toned image produced by the step shown in FIG. 4*e* to an image receiving paper 7.

FIGS. 5*a* to 5*f* show a second process of converting the polarity of the electrostatic latent image from negative to positive according to the invention.

In this second process, in the first place, a composite photosensitive body composed of an electrically conductive layer 1, Se or Se·Te layer 2 and PVK layer 3 is uniformly charged with a negative polarity as shown in FIG. 5*a*. Then, the composite photosensitive body is illuminated by a light image to produce thereon an electrostatic latent image as shown in FIG. 4*b*. Subsequently, the electrostatic latent image is developed by a positive toner 10. In this step, the insulating property of the toner should preferably be high, but is sufficient that the charge is held during the subsequent steps shown in FIGS. 5*d*, 5*e* and 5*f*. Then, the composite photosensitive body as a whole is uniformly charged with a positive polarity as shown in FIG. 5*d*. In this step, it should be noted that the composite photosensitive body underlying the toned image is also charged with the positive polarity. Subsequently, the composite photosensitive body is illuminated by ultraviolet rays as shown in FIG. 5*e*. In this step, since the positively charged composite photosensitive body is sensitive to the ultraviolet rays, the charge on that part of the photosensitive body to which is not adhered the toner becomes absent, while the charge on that part thereof to which is adhered the toner becomes decreased in association with the toner concentration due to the ultraviolet rays which have passed through the toner. As a result, the positively charged electrostatic latent image which is positive with respect to an original picture is produced on the composite photosensitive body. The residual toned image is erased from the surface of the composite photosensitive body as shown in FIG. 5*f*. Alternatively, the toned image as it is may be transferred to an image receiving paper to obtain a first copy. The positive electrostatic latent image thus produced has an excellent dark attenuation property and can be held for a long time. As a result, the positive electrostatic latent image can repeatedly be developed by the toner to obtain a plurality of copies.

FIG. 6 shows a graph illustrating the result of experimental tests on the above mentioned second process. In the present experimental tests, use was made of a Se-PVK composite photosensitive body and the steps shown in FIGS. 5*a* to 5*f* were slightly changed whereby the change in the surface charge potential of the composite photosensitive body was measured. In FIG. 6, the ordinate shows the surface charge potential, while the abscissa represents time which is applied to the course of the dark attenuation only. In FIG. 6, a curve A shows a surface charge potential of the composite photosensitive body to which is not applied the toner developing step shown in FIG. 5*c*, that is, a surface charge potential of the nonpicture image portion thereof. Curves B, C and E show surface charge potentials of picture image portions obtained when the negative charge potential in the step shown in FIG. 5*a* is defined to various values, respectively.

More particularly, the light image illumination step shown in FIG. 5*b* is terminated at a time prior to a time a shown in FIG. 6. A period a-b shown in FIG. 6 shows the dark attenuation. During a period b-c shown in FIG. 6, the toner development shown in FIG. 5*c* is effected. During a period c-d shown in FIG. 6, the composite photosensitive body is uniformly charged with the positive polarity as shown in FIG. 5*d*. Until this time d, the steps illustrated with reference to FIG. 6 are the same as those illustrated with reference to FIG. 5. During a period e-f shown in FIG. 6, the toner erasing step shown in FIG. 5*f* is effected. During a period f-g shown in FIG. 6, the ultraviolet ray illumination step shown in FIG. 5*e* is effected without erasing the toner from the time e. That is, during the period e-f, the toner erasing step shown in FIG. 5*f* is effected, while during the period f-g the ultraviolet ray illumination step is effected without erasing the toner. That is, the experimental tests were effected on two different kinds of samples. But, the curves are shown as of continuous one for the sake of convenience.

A sample shown by the curve B had a picture image portion having a density D=0.86 at the time of the toner development. A sample shown by the curve C had a picture image portion having a density D=1.23 at the time of the toner development, and a sample shown by the curve E had a picture image portion having a density D=1.58 at the time of the toner development.

As described above, the composite photosensitive body has been illuminated by the light image prior to the time a, but absolute values of the potential of the picture image portions shown by the curves B to E are relatively small. This is because of the fact that the composite photosensitive body was uniformly charged to a low potential in the step shown in FIG. 5*a*. But, as described above, the picture image developed by the toner in the subsequent step shown in FIG. 5*c* became sufficiently high in concentration. This is because of the fact that in the toner development step use was made of dry two composition developing agent so as to make a toner mixing ratio high. The toner development step is effected at the time b. At this time b, the toner causes the surface charge of the composite photosensitive body to neutralize, thereby slightly lowering the charge potential of the composite photosensitive body. During the period c to d, the samples are uniformly charged with a positive polarity and hence charged to a high positive potential. In this time, the sample having a higher picture image density, that is, having a higher toner concentration is charged to a higher potential as shown by the curve E. This is because of the fact that the toner is also charged. During a period from d to e, the dark attenuation occurs, but it can be seen from FIG. 6 that such dark attenuation is sufficiently small.

At the time e, the toner is erased and at the same time the toner charge is also erased, so that the surface charge potential becomes lowered. In this case, the higher the toner concentration (in order of the curves E, C, B as shown in FIG. 6) the lower the surface charge potential. For example, the potential or the like of the sample shown by the curve E becomes lower than those of the other samples. This is because of the fact that, in the sample with the toner having the high concentration, the photosensitive body beneath the toner is slightly difficult to be charged at the uniform charging step illustrated with reference to FIG. 5*d*.

During the period from e to f, the dark attenuation occurs. At the time f, the samples are exposed to the ultraviolet rays. In practice, however, this ultraviolet ray exposure step is effected at the time e. As a result, the toner is adhered to the samples. It is a matter of course that the higher the toner concentration is (as shown by the curve E or the like) the more the amount of ultraviolet rays is intercepted by the toner and that the discharge becomes small. The toner concentration shown by the curve C approaches that shown by the curve E. This shows that, in this order of the toner concentration, the final residual potential is not so much influenced by the toner concentration. In that portion of the composite photosensitive body at which the toner image is not produced (curve A), it is natural that the charge becomes rapidly discharged, thereby producing the electrostatic latent image due to the potential difference between the curve A on the one hand and the curves B, C, E on the other hand at the time g, for example.

The above is the principle of the electrophotographic process according to the invention. Apparatus for carrying out the electrophotographic process according to the invention will now be described with reference to two embodiments shown in FIGS. 7 and 8.

FIG. 7 shows one embodiment of an electrophotographic apparatus for carrying out the above mentioned first process in which a positive polarity charge is uniformly applied to a negative electrostatic latent image produced by a composite photosensitive body so as to convert the polarity of the electrostatic latent image from negative to positive, thereby obtaining an electrostatic latent image having a positive polarity. In FIG. 7, reference numeral 21 designates a photosensitive drum whose surface is formed of a composite photosensitve body composed of Se or Se alloy layer and PVK layer superimposed one upon the other. The photosensitive drum 21 is rotated in a direction shown by an arrow. In the first place, the photosensitive drum 21 is uniformly charged with a negative polarity by a first corona discharge device 22.

Then, the photosensitive drum 21 is illuminated by a light image of a manuscript with the aid of a light image illumination device 23 to produce on the surface thereof a negatively charged electrostatic latent image. In order to convert the polarity of the electrostatic latent image from negative to positive, provision is made of a charging drum 24 composed of an electrically conductive drum and a dielectric material layer coated on the surface thereof. Between the dielectric material layer and the electrically conductive drum may be interposed a semiconductor layer so as to prevent nonuniform charge to be induced in the course of transferring the charge to be described later. The charging drum 24 has been charged with a positive polarity to a high potential (1,000 to 2,000 v) by a second corona discharge device 25. The charging drum 24 is urged against the surface of the photosensitive drum 21 to uniformly supply the positive charge to the surface of the photosensitive drum 21, whereby the charge on the negatively charged picture image portion of the electrostatic latent image becomes substantially neutralized, while the noncharged nonpicture image portion of the electrostatic latent image is positively charged. After the polarity of the electrostatic latent image as a whole produced on the photosensitive drum 21 has been converted from negative to positive, the charging drum 24 is separated from the photosensitive drum 21. The positively charged electrostatic latent image is developed by a developing device 26 which makes use of toner particles having a positive polarity. The toner particles are adhered to the noncharged nonpicture image portion of the electrostatic latent image. In this case, if the adhering force of the toner particles is insufficient, a bias voltage may be applied between the developing device 26 and the photosensitive drum 21. Then, the toned image on the photosensitive drum 21 is transferred to an image receiving paper by means of a transfer roller 27. The paper receiving paper 28 is picked up by a pickup roller 29 and fed through a paper guide 30 and feed rollers 31 to the transfer roller 27. As described above, the adhering force of the toner particles to the photosensitive drum 21 is so small that the toned image on the photosensitive drum 21 is easily transferred to the image receiving paper 28, and as a result, it is possible to make a bias voltage to be applied to the transfer roller 27 low.

The use of such low bias voltage provides the important advantage that the toned image can be transferred from the photosensitive drum 21 to the image receiving paper 28 without deteriorating the electrostatic latent image. The image receiving paper 28 with the toned image transferred thereon is guided by a guide plate 32 onto a conveyor belt 33 and the toned image is heated and fixed by an oven fixing device 34. After the fixing operation, the electrostatic latent image on the photosensitive drum 21 is repeatedly developed by the toner developing device 26 to transfer the toned image to a plurality of the image receiving papers. After a required number of copies have been obtained, the residual toner is erased from the surface of the photosensitive drum 21 by a cleaning device 35. The electrostatic latent image on the photosensitive drum 21 may be removed by a lamp 36, if necessary. Since the electrostatic latent image is of positively charged one, the lamp 36 must be an ultraviolet ray lamp, preferably, a fluorescent lamp type ultraviolet ray lamp.

FIG. 8 shows another embodiment of an electrophotographic apparatus for carrying out the above mentioned second process in which a negative electrostatic latent image produced on a composite photosensitive body is developed by toner particles, then is charged with a positive polarity and subsequently exposed to ultraviolet rays so as to obtain an electrostatic latent image having a positive polarity. A composite photosensitive drum 41 is rotated in a direction shown by an arrow and uniformly charged with a negative polarity by a first corona discharge device 42. Then, the photosensitive drum 41 is illuminated by a light image with the aid of an illumination device 43 to produce thereon an electrostatic latent image having a negative polarity. Subsequently, this electrostatic latent image is developed by toner particles in a first developing device 44 and then positively charged by a second corona discharge device 45, thereby obtaining a substantially uniform surface charge potential. Then, an ultraviolet ray source 46 causes the positive charge to discharge in response to the toner concentration to produce a positive electrostatic latent image beneath the toned image. The toned image is erased from the surface of the photosensitive drum 41 by a cleaning device 47, thereby remaining the positive electrostatic latent image only. This positive electrostatic latent image is repeatedly used to obtain copies in the same manner as in the case of apparatus shown in FIG. 7. Such a repetition of the process is effected by means of a second developing device 48 which makes use of toner particles having a negative polarity, image receiving paper 49, pickup roller 50, guide plate 51, transfer roller 52, conveyor belt 53 and oven fixing device 54. It is a matter of course that during such repetition of the process the first developing device 44 or the like is made inoperative.

If the cleaning device 47 makes use of cleaning brushes as shown in FIG. 8, frictional charge causes the electrostatic latent image on the composite photosensitive drum to suffer disturbance. In such a case, the toned image is transferred to a sheet-shaped member (for example, the toned image is transferred to the image receiving paper to obtain a first copy). Alternatively, provision may be made of an intermediate transfer member on which is non-slidably transfer the toned image and the toner particles on the intermediate transfer member are erased by a separate cleaning device. As such intermediate transfer member, use may be made of a sheet-shaped or roller-shaped one. The electric field which functions to transfer the toned image to the intermediate transfer member may be produced for the sheet-shaped intermediate transfer member by using a corona discharge device and may be produced for the roller-shaped intermediate transfer member by applying a bias voltage.

In the case of obtaining one copies picture image by one exposure, the first corona discharge device 42, light image illumination device 43, first developing device 44, transfer roller 52, ultraviolet ray source 46 and cleaning device 47 are made operative in the order as mentioned above, the second developing device 48 being separated from the photosensitive drum 41 and made inoperative.

In the above embodiments, the composite photosensitive body mainly consists of a Se or Se alloy layer and a PVK layer superimposed one upon the other. But, the invention is not limited to such Se-PVK composite photosensitive body, but may be applied to various kinds of photosensitive bodies which exhibit an excellent dark attenuation property when charged with either positive or negative polarity and an excellent light response property when charged with the other polarity. In addition, the apparatus according to the invention is not limited to the embodiments shown in FIGS. 7 and 8, but may be changed to suitable construction inclusive of means for converting the polarity of the electrostatic latent image.

The invention is capable of producing, on a photosensitive body, an electrostatic latent image having an excellent charge holding property, that is, excellent dark attenuation property and of repeatedly using an electrostatic latent image which has once been produced on the photosensitive body for the purpose of obtaining a number of good copies.

What is claimed is:

1. An electrophotographic process using a composite photosensitive body which has an electrically conductive substrate, an inorganic photoconductive semiconductor layer and an organic photoconductive semiconductor layer, said inorganic and organic photoconductive semiconductor layers being applied on said substrate in this order comprises the following successive steps:

(a) a step of uniformly charging the composite photosensitive body in one polarity for which the composite photosensitive body exhibits a high response to visible light;

(b) a step of exposing the uniformly charged composite photosensitive body to an optical image of an original to be duplicated with the visible light for forming a first electrostatic latent image of one polarity;

(c) a step of developing the first electrostatic latent image with toners which have been charged in the opposite polarity and are impermeable to ultraviolet rays to form a primary toner image;

(d) a step of uniformly charging the composite photosensitive body in the opposite polarity for which the composite photosensitive body exhibits a small dark decay;

(e) a step of exposing the composite photosensitive body to ultraviolet rays from the side of the primary toner image, to form a second electrostatic latent image of opposite polarity;

(f) a step of cleaning the primary toner image out of the composite photosensitive body;

(g) a step of developing the second electrostatic latent image of opposite polarity with toners charged in one polarity to form a secondary toner image;

(h) a step of transferring the secondary toner image onto a record sheet to form a duplicated copy; and (i) a step of repeating successively said steps (h) and (i) to form a plurality of duplicated copies.

2. A process according to claim 1, wherein said inorganic and organic photoconductive layers are formed by Se and polyvinyl carbazole, respectively and said one and opposite polarities are negative and positive, respectively.

3. A process according to claim 1, wherein: said inorganic and organic photoconductive layers are formed by Se-Te and polyvinyl carbazole, respectively and said one and opposite polarities are negative and positive, respectively.

* * * * *